US008344955B2

(12) United States Patent
Niemi

(10) Patent No.: US 8,344,955 B2
(45) Date of Patent: Jan. 1, 2013

(54) INTEGRATED ANTENNA WITH E-FLEX TECHNOLOGY

(75) Inventor: Ian Sakari Niemi, Turku (FI)

(73) Assignee: Nokia Corporation, Espoo (FI)

( * ) Notice: Subject to any disclaimer, the term of this patent is extended or adjusted under 35 U.S.C. 154(b) by 347 days.

(21) Appl. No.: 12/655,839

(22) Filed: Jan. 8, 2010

(65) Prior Publication Data

US 2011/0169698 A1 Jul. 14, 2011

(51) Int. Cl.
*H01Q 1/24* (2006.01)

(52) U.S. Cl. ..... 343/702

(58) Field of Classification Search ..... 343/700 MS, 343/702; 455/575.4
See application file for complete search history.

(56) References Cited

U.S. PATENT DOCUMENTS

| | | | | |
|---|---|---|---|---|
| 5,608,413 | A * | 3/1997 | Macdonald | 343/700 MS |
| 5,990,839 | A * | 11/1999 | Schefte et al. | 343/702 |
| 6,504,444 | B1 | 1/2003 | Furuya et al. | 333/1.1 |
| 7,019,221 | B1 | 3/2006 | Noda | 174/255 |
| 7,102,578 | B2 * | 9/2006 | Minemura | 343/702 |
| 7,126,547 | B2 * | 10/2006 | Kim et al. | 343/702 |
| 7,130,591 | B2 * | 10/2006 | Iwai et al. | 455/90.3 |
| 7,289,069 | B2 | 10/2007 | Ranta | 343/702 |
| 2006/0238421 | A1 | 10/2006 | Wielsma | 343/700 |
| 2008/0036668 | A1 | 2/2008 | White et al. | 343/745 |
| 2008/0093118 | A1 | 4/2008 | Takahashi et al. | 174/264 |
| 2009/0174557 | A1 | 7/2009 | Nikitin et al. | 340/572.7 |
| 2010/0045560 | A1 | 2/2010 | Sakuma et al. | 343/793 |

FOREIGN PATENT DOCUMENTS

| | | | |
|---|---|---|---|
| CN | 1014263330 | A | 5/2009 |
| EP | 1 209 758 | A1 | 5/2002 |
| GB | 2 389 246 | B | 8/2005 |
| JP | 2006-121659 | A | 5/2006 |
| WO | WO-00/11747 | A1 | 3/2000 |
| WO | WO-2006/59924 | A1 | 6/2006 |
| WO | WO-2007/116344 | A1 | 10/2007 |

OTHER PUBLICATIONS

"Circular Dipole Antenna for Mode 1 UWB Radio With Integrated Balun Utilizing a Flex-Rigid Structure", IEEE Transactions on Antennas and Propagation, vol. 57, No. 10, Oct. 2009, p. 2967-2971.
"Compact Multi-Band Planar Antenna for Mobile Wireless Terminals", Zygmond Turski et al., IEEE Xplore, Nov. 30, 2009. p. 454-457.
International Search Report for related International Patent Application No. PCT/FI2011/051026 filed Nov. 22, 2011, mailed Apr. 20, 2012.

* cited by examiner

*Primary Examiner* — Huedung Mancuso
(74) *Attorney, Agent, or Firm* — Harrington & Smith

(57) ABSTRACT

A first printed wiring board PWB includes a core and a power layer and a ground layer. A second PWB includes a flexible portion that is partially embedded within an end section of the first printed wiring board and abutting the core. The flexible portion includes a first layer having an antenna feed coupled to the power layer of the core, and a second layer. In a particular embodiment, the second PWB also includes a rigid section in which an opposed end of the flexible portion is also partially embedded.

16 Claims, 10 Drawing Sheets

INTEGRATED ANTENNA WITH E-FLEX TECHNOLOGY

TECHNICAL FIELD

The exemplary and non-limiting embodiments of this invention relate generally to radio antennas, particularly antennas made in a printed wiring board that has a rigid element or portion and a flexible element or portion embedded in and extending from the rigid element.

BACKGROUND

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Cellular radio antennas integrated in a printed wiring board PWB are well known. These integrated antennas have traditionally occupied a relatively large area of the overall PWB, making placement of other circuitry more challenging.

Also well known are cellular radio antennas that are made in or on a flexible substrate. These flex antennas were sometimes disposed directly along an interior surface of the radio housing or cover in order to leave maximum available space for the PWB and other radio components. To avoid inconsistent inductive coupling with a user's hand (for example where the antenna is within a mobile handset and the user may grip the housing differently at different times), these flex antennas were sometimes disposed on the surface of the PWB itself rather than along an inside surface of the radio housing. These flex antennas were coupled to the PWB via spring clips or other such non-permanent connectors in order to enable testing of these flex antennas prior to final assembly. Such connectors removably coupled the flex antenna to the radio engine on the PWB, and so final assembly of the flex antenna to the radio engine was by physically joining the removable connectors on both components to one another. See for example U.S. Pat. No. 7,289,069. To avoid inductive coupling with a user's hand and for other reasons, other flex layers bearing an antenna were embedded as an entire layer of a rigid PWB, but this approach creates problems for circuit designers who must route PWB signal pathways around or through the flexible layer which carries the antenna.

What is needed in the art is an antenna which does not so impair possibilities for engineers to place circuitry on the PWB and which also allows the designer a wide range of choices for positioning the antenna itself.

SUMMARY

The foregoing and other problems are overcome, and other advantages are realized, by the use of the exemplary embodiments of this invention.

In a first aspect thereof the exemplary embodiments of this invention provide an apparatus comprising a first printed wiring board comprising a core having a power layer and a ground layer; and a second printed wiring board comprising a flexible portion that is partially embedded within an end section of the first printed wiring board and abutting the core. The flexible portion comprises a first layer comprising an antenna feed coupled to the power layer of the core, and a second layer.

In a second aspect thereof the exemplary embodiments of this invention provide an apparatus comprising rigid first substrate means comprising a core having a power layer and a ground layer; and second substrate means comprising a flexible portion that is partially embedded within an end section of the first rigid substrate means and abutting the core. The flexible portion comprises a first layer comprising antenna feeding means coupled to the power layer of the core, and a second layer. In a particular embodiment, the first substrate means is a first PWB, and the second substrate means is a second PWB, and there is antenna means (at least one antenna) coupled to the antenna feeding means.

These and other exemplary aspects of the invention are detailed below with more particularity.

DETAILED DESCRIPTION

Figure 1:
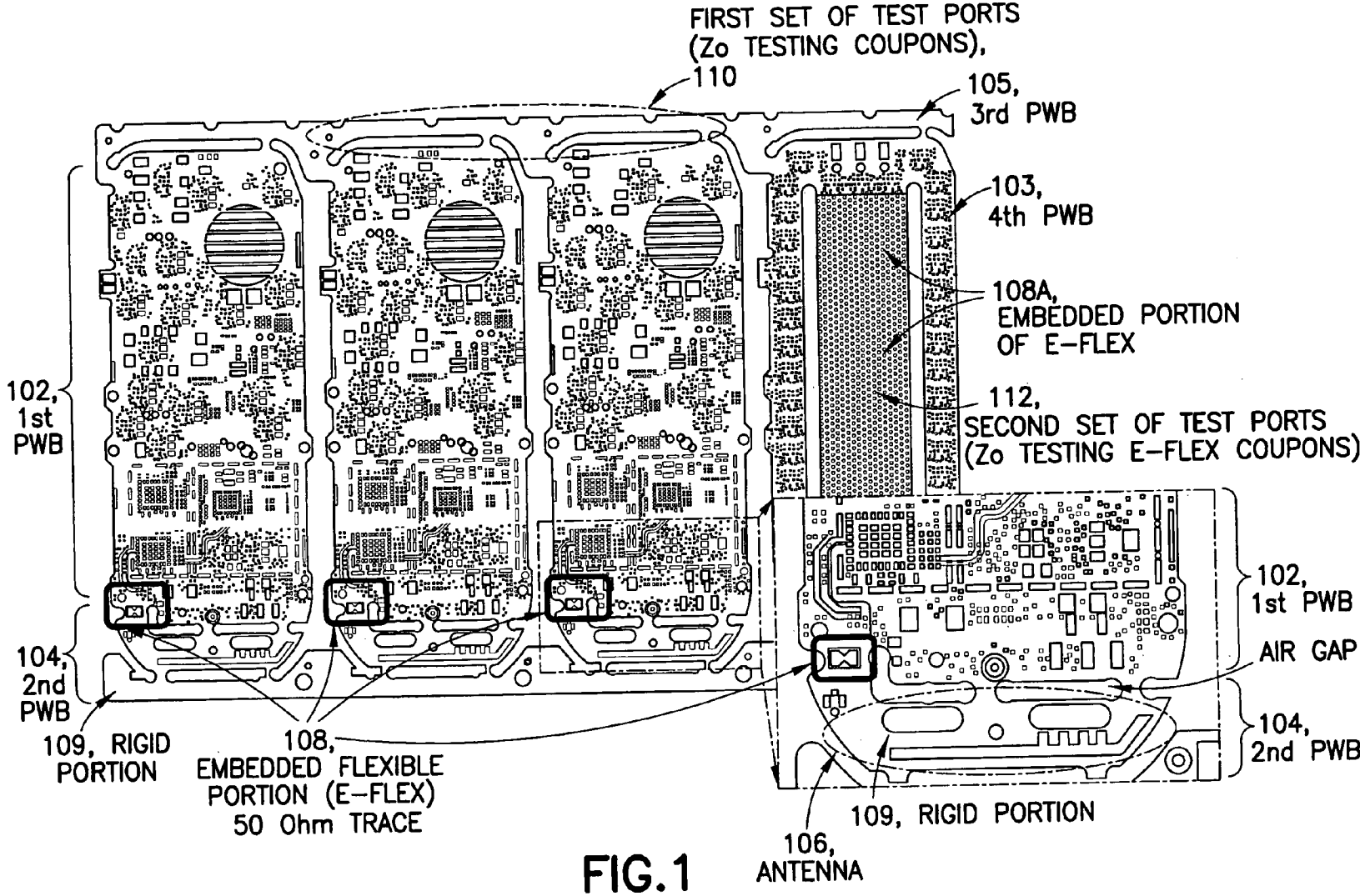
FIG. 1 is a wafer showing in plan view three iterations of a main PWB that is electrically coupled to a second PWB via a flexible substrate according to an embodiment of the invention, in which the antenna lies on the second PWB.

Exemplary embodiments of this invention use an assembly of a first printed wiring board PWB coupled physically and electrically to a second PWB which has a flexible portion that is partially but not fully embedded within the first PWB, as opposed to being coupled via connectors. This assembly is termed a flex-rigid wiring board. The second PWB may have a rigid portion as well as the flexible portion, which would make the entire assembly a rigid-flex-rigid wiring board. An antenna is disposed on the second PWB, within the flexible portion, or within the rigid portion if present, or partially within both flexible and rigid portions. The flexible portion being embedded in the first PWB means that it lies within layers of the first PWB rather than along a surface. As will be detailed, the embedded flexible portion lies adjacent to a core of the first PWB as opposed to along a surface. In a specific example embodiment the antenna is disposed on a rigid portion of the second PWB and the layers of the flexible portion extend through an entire cross section of the rigid portion of the second PWB. Other embodiments are detailed below. Additional embodiments have only the flexible portion but no rigid portion comprising the second PWB and the opposed end (opposite from the first PWB) of the flexible portion free. In these embodiments the antenna is disposed within the flexible substrate.

In the exemplary embodiments, the wording 'antenna' and its derivatives (such as antenna means for example) mean any physical structure capable of radiating (by transmission and/or reception) electromagnetic energy efficiently. It should be appreciated that any number or combination of antennas can exist and that the wording 'antenna' may have many alternative descriptions as known in the art including, and not limited to, a single antenna, multiple antennas, a single resonator, multiple resonators, a single parasitic antenna, multiple parasitic radiators, a single radiator, multiple radiators, a single antenna radiator, multiple antenna radiators, a single antenna element, multiple antenna elements, a single element, or multiple elements. Additionally, it should be appreciated that the 'antenna' may be any type of antenna as known in the art, for example, and not limited to: dipoles, monopoles, planar inverted-F antennas, planar inverted-L antennas, loop antennas, patch antennas, plate antennas, inverted-F antennas, inverted-L antennas, folded monopoles, folded dipoles, antenna arrays, diversity antennas, parasitic antennas, loaded antennas, helical antennas, meander antennas, fractal antennas, bent or folded antennas, hybrid antennas (combinations of known antenna types), microstrip or stripline antennas, spiral antennas, coil antennas, and so on.

At least the first PWB is rigid, which can be measured by supporting only one end of the planar PWB and measuring out of plane deflection at the opposed end where the deflection is due to only the weight of the PWB itself. If deflection measured at the far end is not substantial the PWB is rigid. The flexible substrate will show substantial deflection out of plane under its own weight under a similar measurement. In an example embodiment a portion of the second PWB is also rigid.

The exemplary embodiments of the invention summarized above enable testing of integrated antennas before the pair of coupled PWBs are manufactured, which reduces waste as compared to testing only after an antenna is integrated into a PWB (since those products that fail testing are discarded). The flexible portion of the second PWB also gives the circuit designer more flexibility in how to place other circuitry in or on the first PWB, since the flexible substrate enables folding which reduces the area on the first PWB that would otherwise need to be set aside for the antenna. Embedding the flexible substrate also reduces the height required for the overall flex-rigid wiring board as compared to using connectors to couple an antenna on the flexible substrate to the PWB core layers.

Antennas that are constructed according to certain exemplary embodiments detailed below also enhance performance as compared to those noted above that are connected to the PWB via removable connections. This performance enhancement arises because the embedded connection avoids parasitic & harmonic effects in high frequency digital and analog signals that occur from removable connectors, for example, passive intermodulation distortion. Conveniently, embedding the flexible substrate adjacent to the core of the PWB puts the antenna closer to the power and ground layers of the PWB, so conductive layers for power and ground of the flexible portion of the second substrate can be coupled to power and ground layers of the first PWB at the embedded section.

Certain other exemplary embodiments of the antenna detailed below enhance performance due to physical separation from the engine-module or first PWB, across an air gap, where air is then the dielectric media. This air gap and the folding option enable placement of the antenna in various locations within the host device, for example, within the mobile handset, relative to the host device housing/cover and other device mechanics. Embodiments in which the antenna lies in or on the second PWB gives the circuit designer a 3D mechanical solution so as to place the antenna in the vicinity of the host device housing/cover at a location where performance is enhanced, for example, by exploiting or avoiding positions where a user's hand would hold the host device housing. Manufacture of the host device may also be streamlined in that the antenna can be assembled simultaneously with the radio engine module for the case where that module is mounted to the rigid first PWB 102.

One example embodiment is shown at FIG. 1, which illustrate three identical embodiments fabricated from a common wafer and not yet separated from one another. There is a first PWB 102 on which may be embodied circuitry such as one or more radio engines and/or matching circuitry to match the antenna to the radio circuitry. There is a second PWB 104, having a flexible portion 108 and a rigid portion 109, on which an antenna 106 is embodied along a major surface of the rigid portion 109. Close inspection of FIG. 1 shows that the antenna is actually an inverted-F antenna comprising two 'arms'. The short arm is surrounded by the longer arm, and the longer arm has a meandered portion along its length. As an example, the short arm may generate a high frequency band response around 2 GHz, whilst the long arm may generate a low frequency band response around 1 GHz. In such an inverted-F antenna there is a RF feed and a ground connection feed, both feeds meeting at a common junction point on the antenna 106. There is a section of the flexible portion 108 (abbreviated herein as e-flex) which is embedded within the first PWB 102, and also an exposed section of the flexible portion 108 is shown between the first PWB 102 and the rigid portion 109 of the second PWB 104. The flexible portion 108 includes circuit traces that define an antenna feed to couple the antenna 106 to the radio circuitry that lies on the first PWB 102. In certain embodiments the antenna may couple via the flexible substrate 108 to a switch which actively switches the antenna 106 between an active antenna mode (for example, by closing a circuit with a transceiver) and a passive antenna mode (for example, by opening a circuit with the transceiver). The ground plane with which the antenna 106 resonates may be disposed within the rigid first PWB 102 or within the rigid portion 109 of the second PWB 104, the selection being dependent at least in part on the type of antenna 106 to which it is matched as known in the antenna arts. As known in the art of printed wiring boards, printed wiring boards may comprise one or more layers and the ground plane may be disposed on one layer of the first PWB 102 or second PWB 104, or the ground plane may be disposed on more than one layer.

FIG. 1 additionally illustrates an air gap between the first PWB 102 and the rigid portion 109 of the second PWB 104. The air within that gap is an efficient dielectric medium between the antenna 106 and the radio circuitry located at the rigid portion 109 of the first PWB 102, and may be beneficial for certain exemplary embodiments to have the antenna 106 disposed in a position proximal (via folding at the flexible portion 108) to the radio circuitry in order to avoid parasitic coupling.

Also shown at FIG. 1 is a first set of electrical test ports 110 ('characteristic impedance' or 'Zo' testing coupons) disposed at a third PWB 105 which are for testing the printed wiring board dielectric material and an arrangement of conductive layers with respect to frequency. The characteristic impedance (Zo) test may provide results for a testing coupon comprising a radio frequency (RF) transmission line arranged between a first set of electrical test ports 110. The test results may provide characteristic impedance values as a complex impedance (Ohms). The first PWB 102 and the rigid portion 109 of the second PWB 104 are cut from the third PWB 105 during manufacture in the FIG. 1 embodiment, and test signals are input to a test port of the first set 110 and impedance is measured at another test port of the first set 110 to assure impedance near 50 ohms in this example.

There may also be a second set of electrical test ports 112 which are disposed along a portion 108A of the flexible substrate 108 that is embedded within a fourth PWB 103. The second set of electrical test ports 112 are for testing various layers of the e-flex material itself, such as for example transmission path, dielectric constant, and loss tangent, with respect to frequency, to name a few possible testing parameters. Both the third PWB 105 and the fourth PWB 103 and their related testing ports 110,112 are for manufacture only and are removed prior to final assembly of the combined first 102 and second 104 PWBs into an end product such as a mobile terminal.

Figure 2:
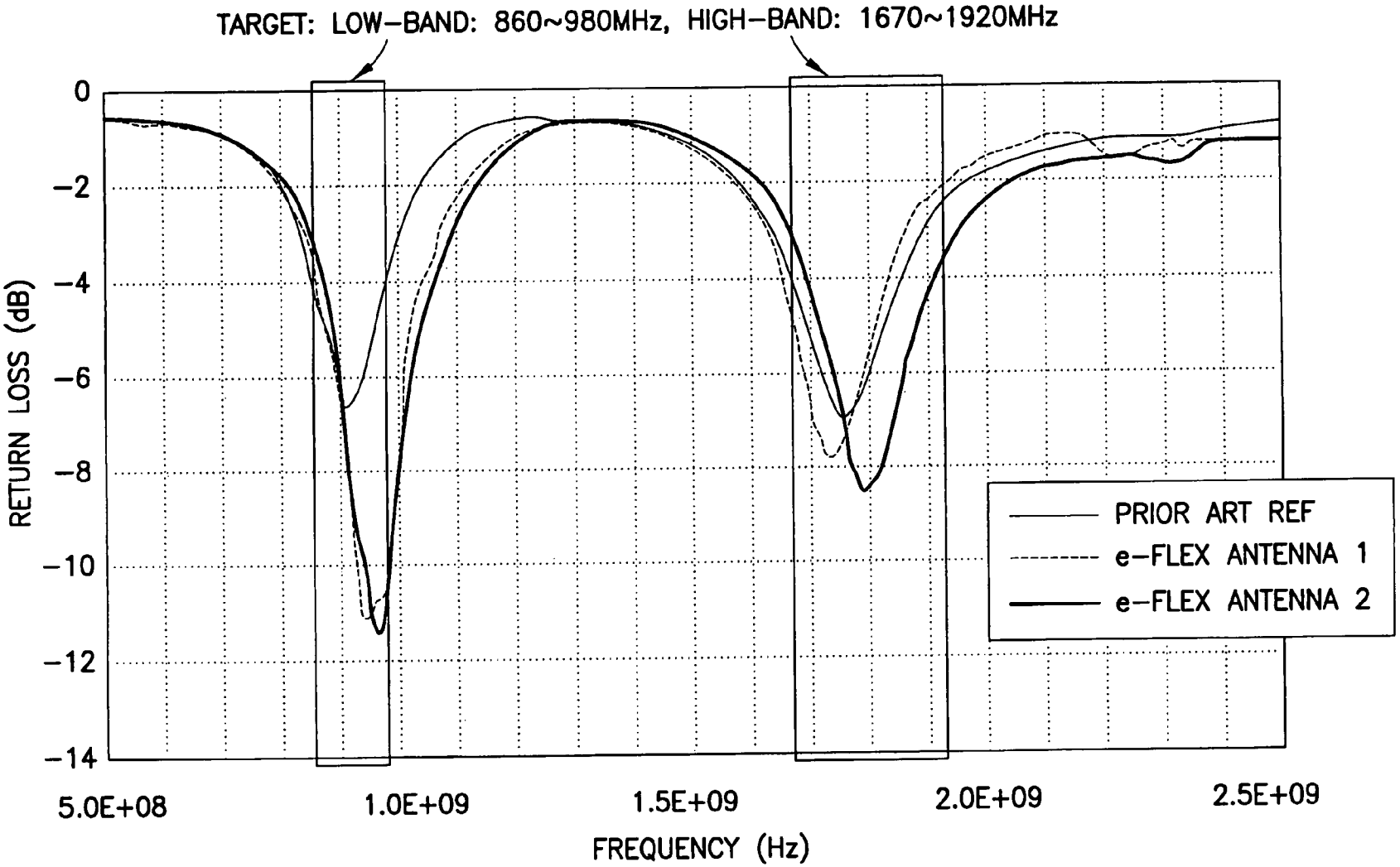
FIG. 2 is a plot comparing return loss across various frequencies for a prior art antenna and two different antennas made according to these teachings.

FIG. 2 is a data plot of return loss (S-parameter measurement, S11) across various frequencies for three antennas: one according to the prior art which is a reference antenna and two different antennas (e-flex antennas 1 and 2) made according to these teachings. The most distinct performance improvement of the two example e-flex antennas over the reference antenna is seen at the lower frequency band illustrated in FIG. 2, at 860-980 MHz. The prior art reference antenna has a return loss in that band of about −6.5 dBm, whereas the e-flex antennas 1 and 2 have return losses about −11 dBm and the prior art reference antenna has a narrower bandwidth. The return loss improvement in the higher frequency band 1670-1920 MHz is less pronounced and the bandwidth is approximately equivalent there as between the three antennas, but the −1 to −1.5 dBm improvement in the high frequency band over the reference antenna is significant nonetheless.

Figure 3:
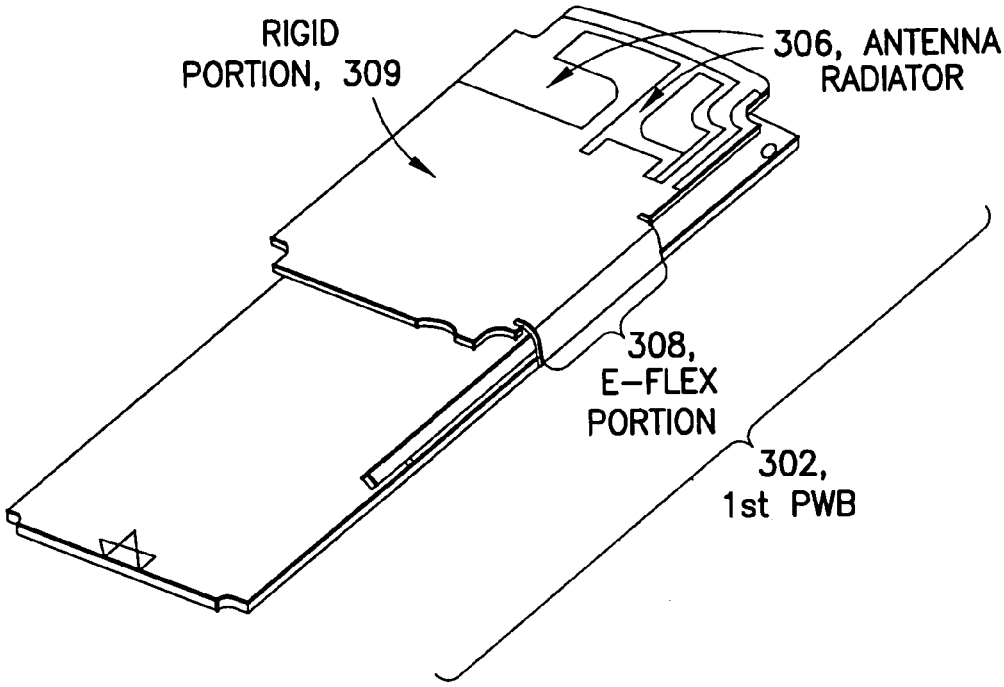
FIG. 3 is a perspective schematic cutaway view of a second PWB bearing an antenna and folded over the top major surface of the main PWB to which it is electrically coupled via a flexible substrate according to an exemplary embodiment of the invention.

FIG. 3 illustrates another example embodiment of the flex-rigid wiring board with an antenna 306. The first PWB 302 is the larger of the two PWBs and the e-flex portion 308 is folded such that the rigid portion 309 of the second PWB, on which the antenna 306 is disposed, overlies a major surface of the first PWB 302. There is still an air gap to isolate the antenna 306 from electronics disposed on the first PWB 302, but in this case it is a vertical air gap as opposed to a horizontal one (where by convention the vertical is perpendicular to the largest major surface of the first PWB). The circuit designer is able to dispose the e-flex portion 308 for several different folding options, which gives the designer greater flexibility in arranging other circuitry on the first PWB 302, on the rigid portion 309 of the second PWB, and also giving the designer options as to three-dimensional mechanical placement of the antenna 306 relative to the ground plane and to the housing/cover of the host device of which the rigid-flex-rigid wiring board of FIG. 3 will become a part.

Figure 4:
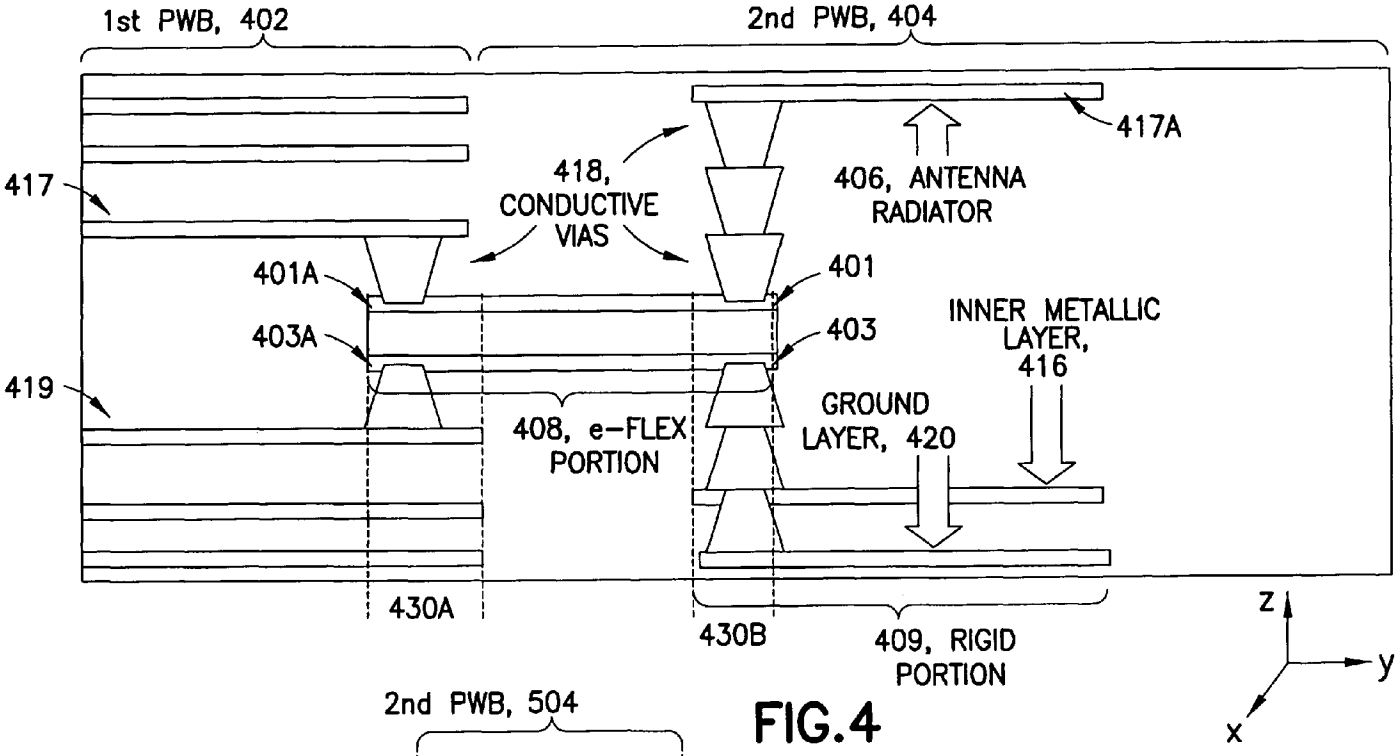
FIG. 4 is a cutaway view of a flex-rigid wiring board illustrating a flexible substrate electrically connecting two rigid PWBs in which the flexible substrate is embedded, in accordance with an exemplary embodiment of this invention.

FIG. 4 is a sectional view showing inner layers of the PWBs. The first PWB 402 has metallic inner layers 416 of which at least some electrically interface with the e-flex portion 408 of the second PWB 404 through conductive vias 418 that penetrate the various layers of the first PWB 402. Similar layers and interfaces are present at the rigid portion 409 of the second PWB 404, which in FIG. 4 carries the antenna 406. Specifically, there is a power layer 417 of the first PWB 402 which is coupled to an antenna feeding point 401A of a first antenna layer 401 of the flexible portion 408 of the second PWB 404, and there is a ground layer 419 of the first PWB 402 which is coupled to a ground feeding point 403A of a second or ground layer 403 of the flexible portion 408 of the second PWB 404. Note that for the case of a monopole antenna 406 the ground may reside only on the first or main PWB 402 and so the ground feeding point 403A as FIG. 4 illustrates is not necessary for every embodiment. The antenna layer 401 of the flexible portion 408 is also coupled to the antenna 406 on a power layer 417A of the second PWB 404, and the ground layer 403 of the flexible portion 408 is also coupled to a ground layer 420 of the second PWB 404. Separation of the antenna 406 from the ground layer 420 is unaffected by the presence of any inner conductive layers 416 between them.

The sectional view of FIG. 4 reveals that there is an embedded section 430A of the flexible portion 408 which is embedded within the first PWB 402. There is also in the embodiment of FIG. 4 an embedded section 430B of the flexible portion 408 which is embedded within the rigid portion 409 of the second PWB 404.

The ground layer 420 may or may not be included in the $2^{nd}$ PWB 404 dependent on the antenna type. For example a monopole or inverted F-type antenna may not have a ground plane beneath it and offset only along the z-axis (see Cartesian coordinates at FIG. 4), but might instead have a ground plane in the adjacent $1^{st}$ PWB 402 so that the ground plane is co-planar (x-y plane as shown at FIG. 4) with respect to the antenna 406. If it is desired to dispose a ground plane beneath the antenna and offset only along the z-axis or vertical direction (for example, a Planar Inverted F Antenna or PIFA) then the antenna 406 might be disposed as in FIG. 4. In this example the antenna 406 does not need to be folded over the first PWB 402 because the ground layer 420 in the rigid portion 409 provides the ground plane for the antenna radiator 406. In various exemplary embodiments, the ground layer 419 in the first PWB 402 may be the ground plane for the antenna radiator 406 when the rigid portion 409 is folded over the first PWB 402 in the final assembly such as in FIG. 3. This may achieve the appropriate z-axis disposition with maximum distance between antenna 406 and ground plane layer 419 in the first PWB 402 so as to maximize radiation efficiency performance and bandwidth.

Figure 5:
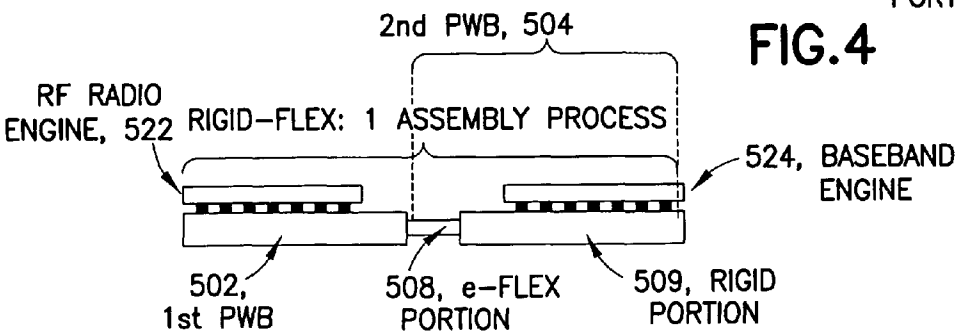
FIG. 5 is a side view schematic diagram of two PWBs electrically coupled to one another by an embedded flexible substrate, according to an exemplary embodiment of the invention.

FIG. 5 is a sectional view of the rigid-flex-rigid wiring board with radio engines fixed to the two rigid portions and illustrating an exemplary embodiment in manufacturing. As with earlier embodiments there is a first PWB 502, a second PWB 504 which has a rigid portion 509 and a flexible portion 508 of which one section is embedded adjacent to a core of the first PWB 502 and another section is embedded adjacent to a core of the rigid portion 509 of the second PWB 504. The only section of the e-flex portion 508 that is shown in FIG. 5 is the un-embedded portion which serves as the electrical conduit between the first PWB 502 and the rigid portion 509 of the second PWB 504. With the arrangement of FIG. 5, various circuitry components or modules, such as for example the radio-frequency RF radio engine 522 and the baseband radio engine 524 illustrated at FIG. 5, can be assembled onto the two rigid segments 502 and 509 of the rigid-flex-rigid wiring board simultaneously. This is because the electrical interconnects between the first PWB 502 and rigid portion 509 of the second PWB 504 lie along the e-flex portion 508 of the second PWB, whose electrical connections through inner and/or outer metallic layers are already formed during manufacture of the overall rigid-flex-rigid wiring board. Interconnecting the RF radio engine 522 with the baseband radio engine 524 then simply requires making the electrical connections to the respective first PWB 502 and the rigid portion 509 of the second PWB 504.

The sectional view of FIG. 4 illustrated only two conductive layers 401A, 403A in the flexible portion 408 of the second substrate 404. For the case where more complex components, such as the example baseband radio engine 524 or an integrated circuit or a semiconductor component, there may be additional conductive layers or further circuit traces for additional connections, such as for example DC power supply, AC power supply, analog signals, digital signals, and RF signals, to name but a few. For example, there may be two e-flex portions 408 as shown in FIG. 4 disposed over one another and separated by an insulating layer, such that there would then be four conductive layers for porting different types of signals between the first PWB 402 and the rigid portion 409 of the second PWB 404. This concept can be extended to six, eight, etc. conductive layers within one or more strips of flexible portion 408. If the e-flex portion 508 were not embedded adjacent to the core of the PWBs 502, 504 but were instead a surface connection, manufacture would generally require disposing one of the radio engines 522, 524 on its respective PWB 502, 504, then disposing the other radio engine on its respective PWB, then disposing the e-flex portion 508 so as to electrically connect them.

Figure 6A:
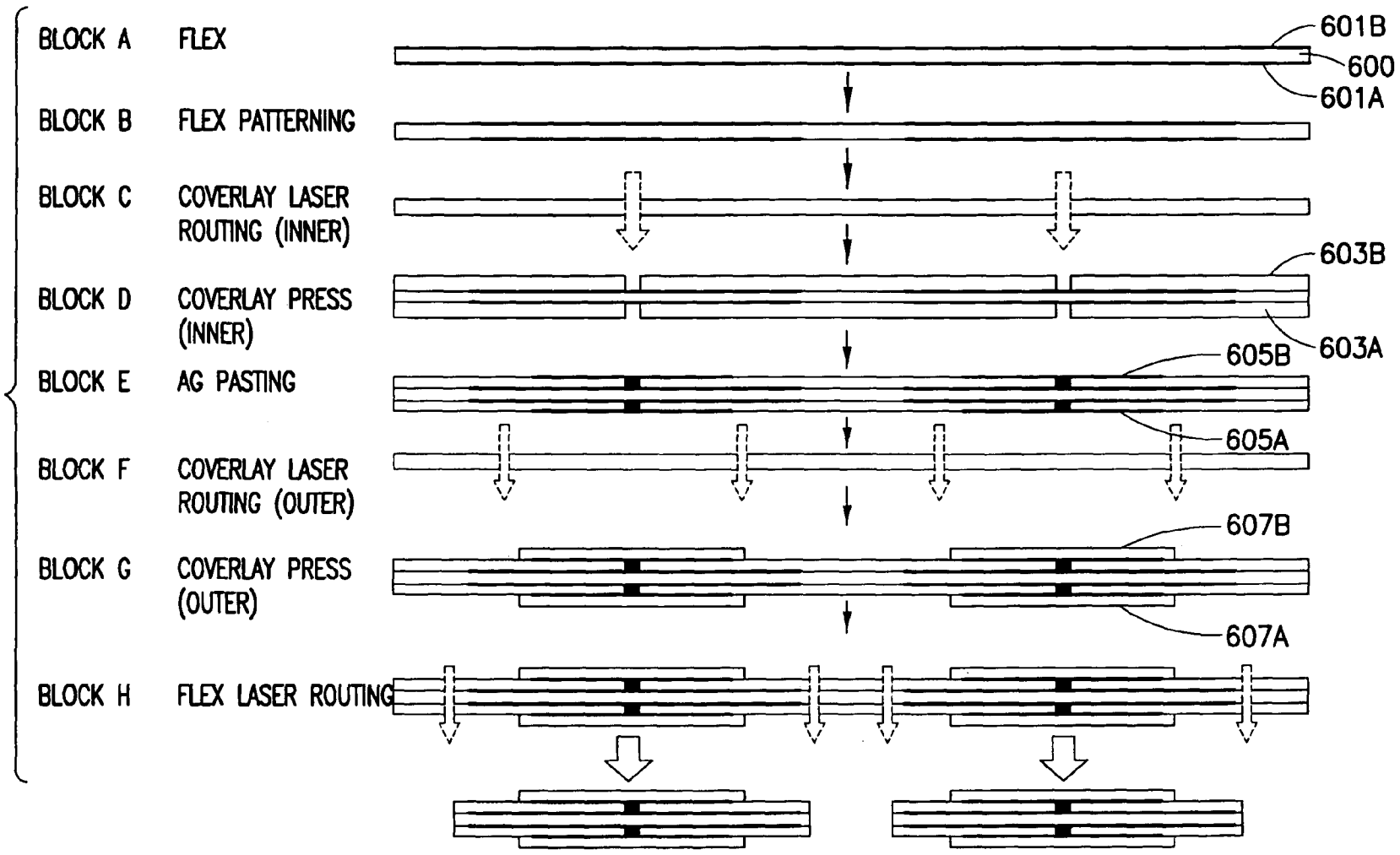
FIGS. 6A-C illustrate process blocks for making a PWB with an embedded flexible substrate and then dividing the PWB into two PWBs which remain electrically coupled by the flexible substrate, according to an embodiment of these teachings.
Figure 6B:
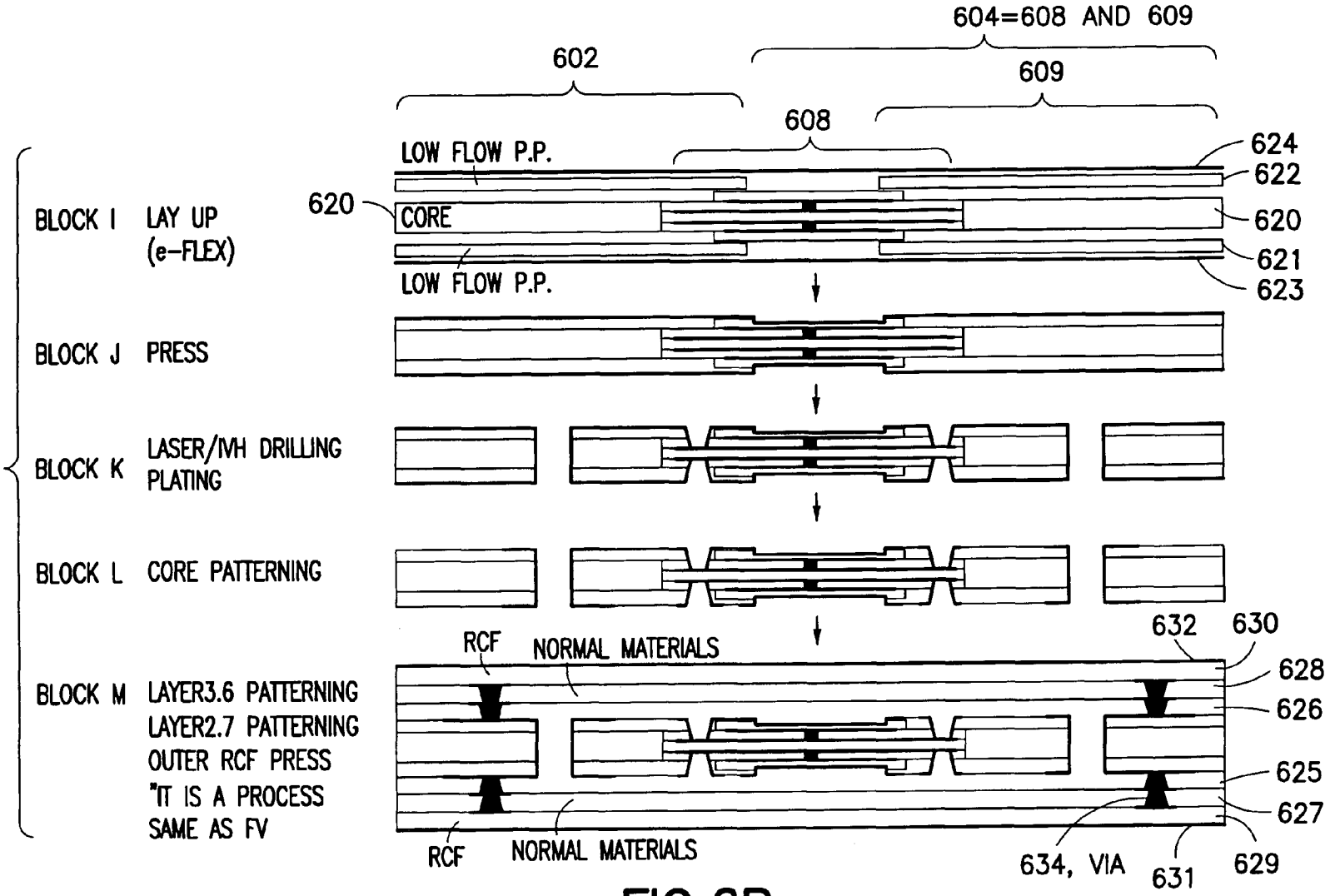
Figure 6C:
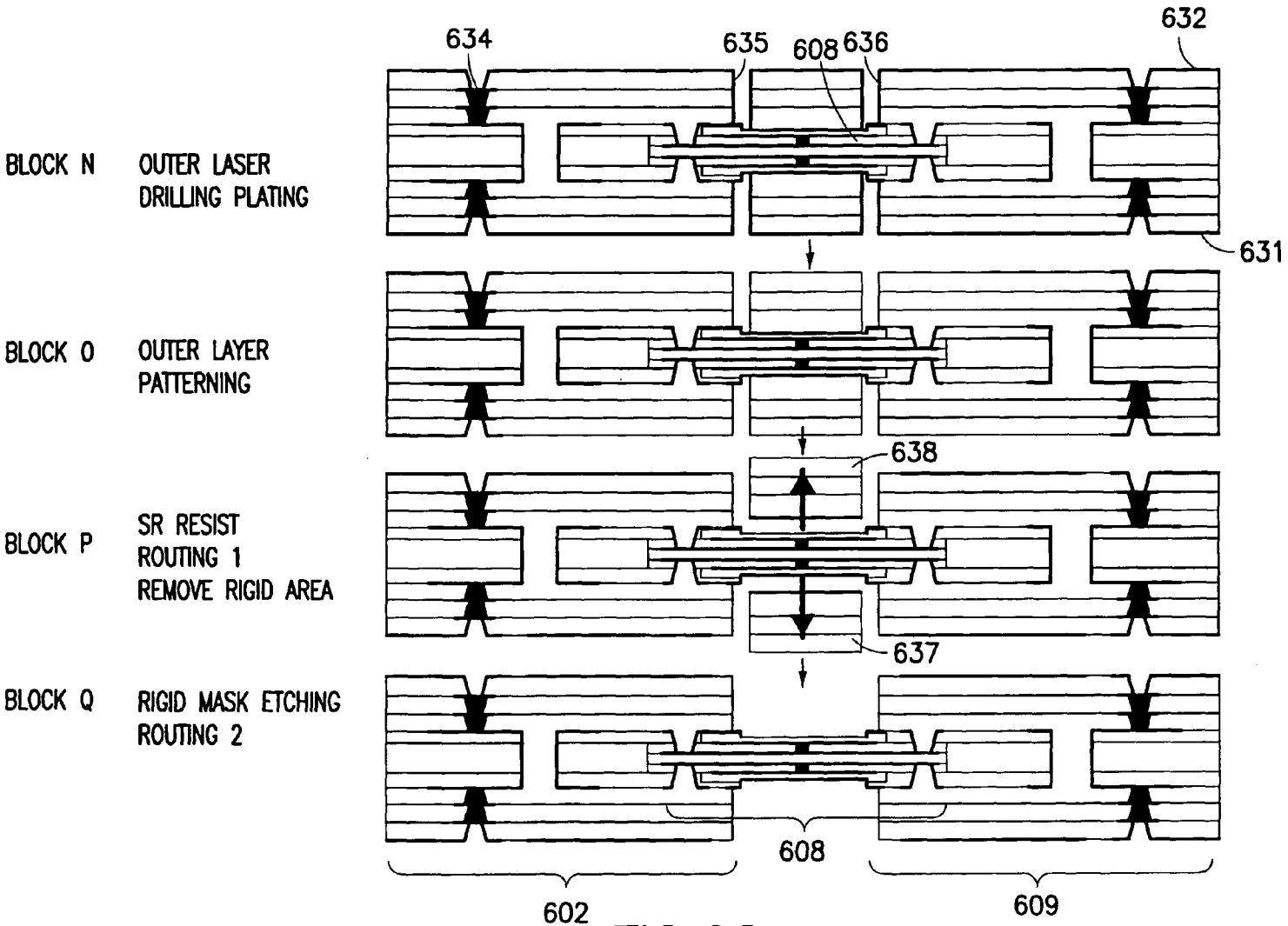

FIGS. 6A to C illustrate an example of how the rigid-flex-rigid wiring board with the antenna disposed therein is arranged. The flexible portion 608 is formed according to the blocks of FIG. 6A, and it is embedded to the first PWB 602 and the rigid portion 609 of the second PWB 604 at FIGS. 6B and 6C. Each of FIGS. 6A to C proceed from top to bottom.

FIG. 6 begins at block A with a flexible portion 600 of a substrate having conducting layers 601A, 601B on opposed sides. In an example embodiment the substrate 600 is polyimide at a thickness of about 20-50 microns, and the conducting layers 601A, 601B are copper, aluminum, gold or an alloy or compound having at least one of those elements and at a thickness of about 5-15 microns. At block B one or both of the conductive layers 601A, 601B are patterned, such as for example via laser ablating or chemical etching to form circuit lines that will eventually interconnect the two PWBs 602, 604.

At blocks C and D inner coverlays 603A, 603B are provided and disposed on the patterned conducting layers 601A, 601B. In an embodiment these coverlays 603A, 603B are press fit and comprise an insulating material such as polyimide at a thickness of 5-15 microns. At block D the inner coverlays 603A, 603B are penetrated via laser or chemical etch to form a via or opening to the patterned conducting layers 601A, 601B below.

At block E a shield layer 605A, 605B such as for example silver paste at a thickness of 5-15 microns is disposed over the inner coverlays 603A, 603B and fills the vias so as to electrically connect with the underlying patterned conductors 601A, 601B. At blocks F and G outer coverlays 607A, 607B are provided and disposed over the shield layers 605A, 605B. Then at block H the assembly is divided into two separate e-flex films such as by laser routing or other cutting technique. Note that the shield layers 605A, 605B do not extend to the edges of the substrate 600 after dividing; this is in anticipation of the overlap of the substrate 608 with the first PWB 602 and the rigid portion 609 of the second PWB 604 in which the shield layers 605A, 605B are adjacent to but not embedded within the first PWB 602 or the rigid portion 609 of the second PWB 604 as will be seen at FIGS. 6B and 6C. Only one of the flexible portions 608 that result from FIG. 6A are considered in the further processing at FIGS. 6B and 6C. Note that at this point, for embodiments in which the antenna is patterned on the flexible portion 608, the antenna can be tested without being further assembled into the rigid-flex-rigid wiring board.

At block I of FIG. 6B the flexible portion 608 from FIG. 6A is laid up adjacent to two core layers 620 of what will eventually be the first PWB 602 and the rigid portion 609 of the second PWB 604. The second PWB 604 is the rigid portion 609 combined with the flexible portion 608. In an embodiment the core layer is a non-flexible substrate such as glass infused with an epoxy resin at a thickness of about 50-150 microns. About opposed major surfaces of the core 620 are laid up insulating layers 621, 622 such as for example glass cloth impregnated with epoxy resin (to assure low flow of the resin at elevated polymerization temperatures), then inner conducting layers 623, 624 such as for example copper, aluminum or gold at a thickness of about 5-15 microns. Note that at least the conducting layers 623, 624 span the core 620 of the first PWB 602, the core 620 of the rigid portion 609 and the flexible portion 608. These various layers are press bound at block J.

At block K penetrations are formed between opposed outer surfaces of the assembly resulting from the press at block J. Note that this is not a dividing of the assembly as was done at FIG. 6A, but rather holes are formed (for example by laser ablation or mechanical drilling) and plated with a conductor to result in tunnels with conductive sidewalls. At block L the inner conducting layers 623, 624 are patterned for circuitry and wiring interconnects.

Block M combines several known PWB manufacturing blocks in which alternating insulating layers and conducting layers are disposed and the conducting layers are patterned. Specifically as shown at block M, there are insulating layers 625, 626, 627, 628, 629 and 630, with a patterned conducting layer between adjacent ones of those insulating layers. By example the insulating layers are polyimide at a thickness of about 5-15 microns and the conducting layers are copper, aluminum or gold at a thickness of about 5-15 microns. There is an outer conducting layer 631, 632 on opposed major surfaces of the stack. While patterning the different conducting layers, vias 634 are drilled and filled with a conductor or plated to interconnect circuit traces from one layer to another.

Continuing the process at FIG. 6C, block N shows that the outer conducting layers 631, 632 are drilled to connect to other filled vias 634 or directly to underlying patterned circuitry or traces at other conductive layers. Also at block N the outboard ends 635, 636 of the first PWB 602 and the rigid portion 609 of the second PWB 604 are defined by drilling down to but not through the flexible portion 608. At block O the outer conducting layers 631, 632 are patterned.

At block P the portions 637, 638 of the layers which lay between the defined ends 635, 636 of the first PWB 602 and the rigid portion 609 are removed, exposing that portion of the flexible portion 608 that is not embedded within either of the first PWB 602 or rigid portion 609. This can be accomplished by various techniques, including for example chemical etching after protecting areas not to be etched with a resist mask, or laser routing. At block Q if a resist mask was used at block P it is removed from the outer surfaces of the first PWB 602 and rigid portion 609 via etching or laser routing for example. Electrical components/modules such as the engines shown at FIG. 5 are then affixed to the patterned conductive layers 631, 632 that lie on the outboard surfaces of the rigid-flex-rigid board shown at FIG. 6C.

Figure 7A:
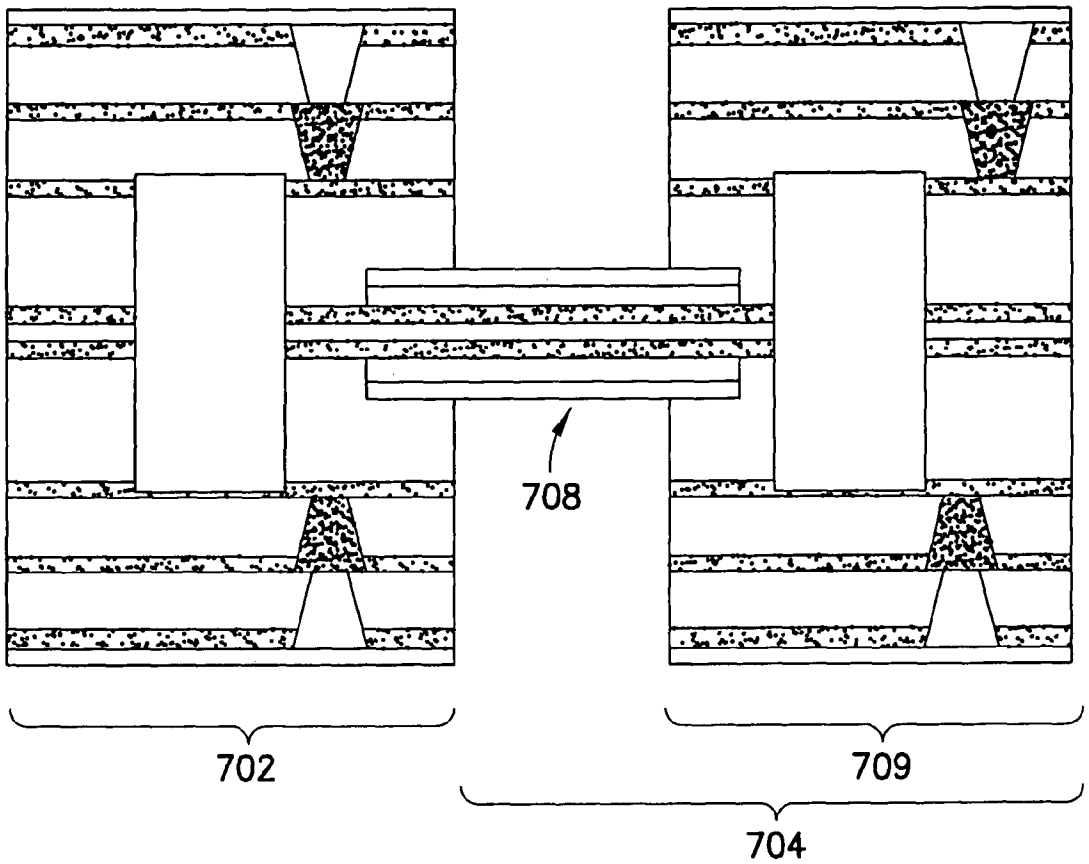
FIGS. 7A-B illustrate similar to FIG. 4 but show different extents to which the flexible substrate is embedded in the PWB.
Figures 1, 7A:
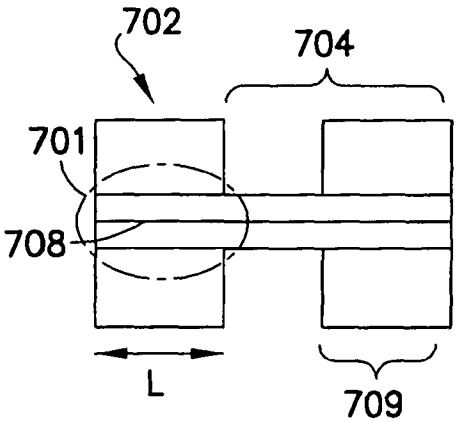
Figure 7B:
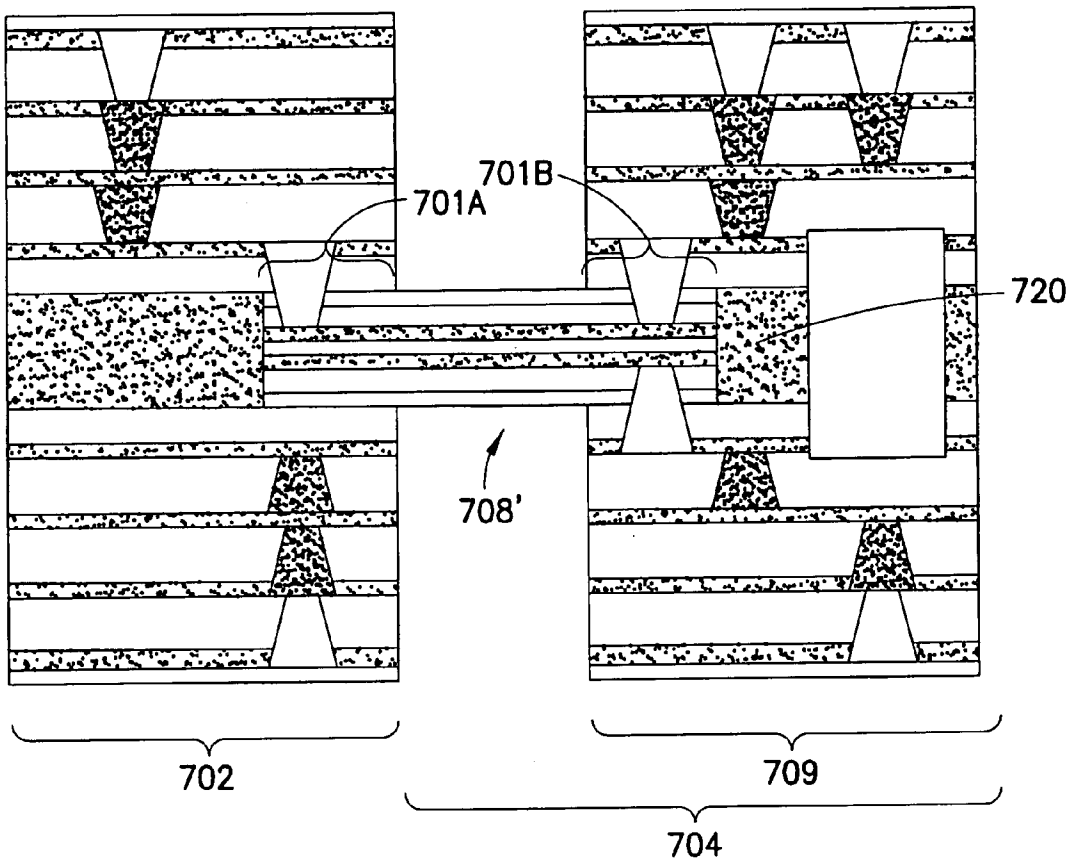
Figures 1, 7B:
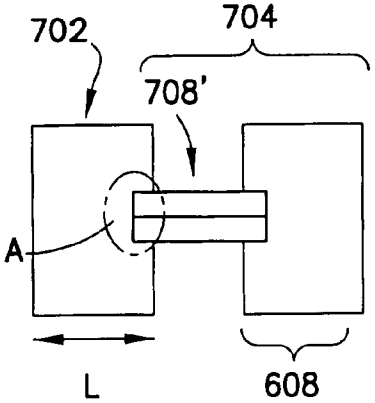

FIGS. 6B to 6C illustrate one particular sectional view of the overall rigid-flex-rigid wiring board. FIGS. 7A to 7B illustrate different sectional views of the flexible portion 708 that are embedded in the first PWB 702 and the rigid portion 709 of the second PWB 704. The example embodiment of FIG. 7A illustrates where the antenna is patterned on the flexible portion 708 itself.

As seen in the sectional inlay 7A-1, layers of the flexible portion 708 spans the length L of at least one (and as shown both) of the first PWB 702 and the rigid portion 709 of the second PWB 704. This is somewhat restrictive of the circuit designer's flexibility in placing other circuitry on that rigid-flex-rigid assembly.

Contrast this with FIG. 7B in which the flexible portion 708' penetrates only partially within the first PWB 702, and also partially within the rigid portion 709 of the second PWB 704. In this embodiment the flexible portion 708' lies adjacent to the separate core layers 720 of the first PWB 702 and the rigid portion 709 of the second PWB 704. The inlay view at FIG. 7B-1 illustrates that the embedded section 701A, 701B of the flexible portion 708' extends substantially less than the length L of either the first PWB 702 or the rigid portion 709 of the second PWB 704. In a particular embodiment, there is a first end section 701A of the flexible portion 708' that is partially embedded 701A adjacent to a core of the first PWB 702 as in FIG. 7B-1, and there is an opposed second end section 701B of the flexible portion that is partially embedded adjacent to a core 720 of the rigid portion 709 of the second PWB 704 as in FIG. 7B-1. The antenna itself may be confined only to the rigid portion 709, or it may span along both the rigid portion 709 and the flexible portion 708' of the second substrate 704.

Figure 8:
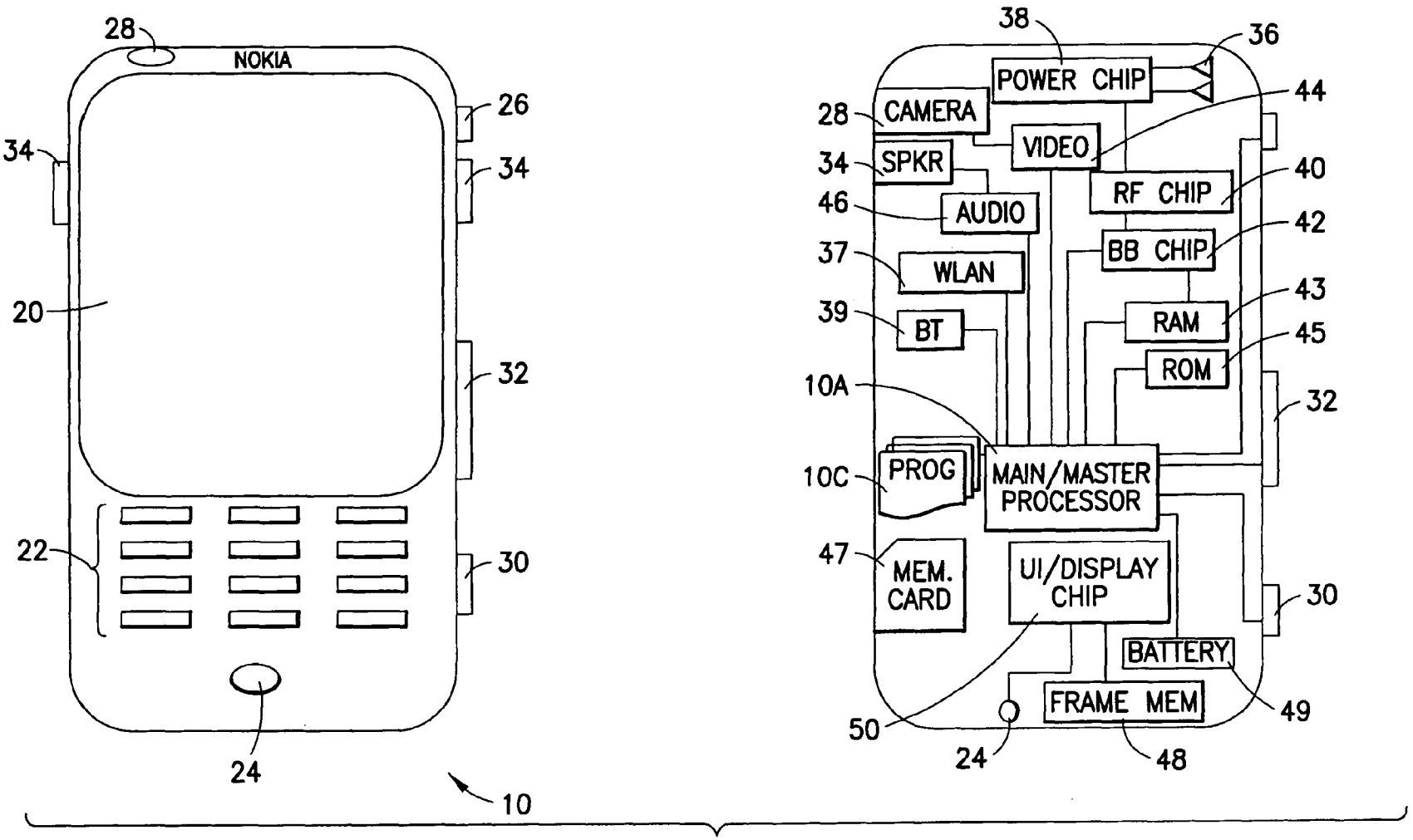
FIG. 8 is a plan view and a sectional view of a mobile user equipment/host device in which exemplary embodiments of the invention may be disposed.

FIG. 8 illustrates schematic diagrams of an electronic host device, for example a portable electronic device/user equipment (UE) 10, in which exemplary embodiments of the invention may be disposed. The UE 10 includes a controller, such as a computer or a data processor (DP) 10A, a computer-readable memory medium embodied as a memory (various memories shown 43, 45, 47) that stores a program of computer instructions (PROG) 10C, and a suitable radio frequency (RF) transceiver for bidirectional wireless communications via one or more antennas 36.

In general, the various embodiments of the UE 10 can include, but are not limited to, cellular telephones, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

The computer readable memories may be of any type suitable to the local technical environment and may be implemented using any suitable data storage technology, such as semiconductor based memory devices, flash memory, magnetic memory devices and systems, optical memory devices and systems, fixed memory and removable memory. The DP 10A may be of any type suitable to the local technical environment, and may include one or more of general purpose computers, special purpose computers, microprocessors, digital signal processors (DSPs) and processors based on a multicore processor architecture, as non-limiting examples.

At FIG. 8 the UE 10 has a graphical display interface 20 and a user interface 22 illustrated as a keypad but understood as also encompassing touch-screen technology at the graphical display interface 20 and voice-recognition technology received at the microphone 24. A power actuator 26 controls the device being turned on and off by the user. The exemplary UE 10 may have a camera 28 which is shown as being forward facing (e.g., for video calls) but may alternatively or additionally be rearward facing (e.g., for capturing images and video for local storage). The camera 28 is controlled by a shutter actuator 30 and optionally by a zoom actuator 32 which may alternatively function as a volume adjustment for the speaker(s) 34 when the camera 28 is not in an active mode.

Within the sectional view of FIG. 8 are seen multiple transmit/receive antennas 36 that are typically used for cellular communication. The antennas 36 may be multi-band for use with other radios in the UE. The operable ground plane for the antennas 36 may be disposed in any of various locations as noted above depending on the type of antenna being used, the first PWB spans the whole of the sectional view and is shown by shading, and the second PWB is folded over the top of the first PWB and carries the power chip 38 and the antennas 36. The power chip 38 controls power amplification on the channels being transmitted and/or across the antennas that transmit simultaneously where spatial diversity is used, and amplifies the received signals. The power chip 38 outputs the amplified received signal to the radio-frequency (RF) chip 40 which demodulates and downconverts the signal for baseband processing. The baseband (BB) chip 42 detects the signal which is then converted to a bit-stream and finally decoded. Similar processing occurs in reverse for signals generated in the apparatus 10 and transmitted from it.

Signals to and from the camera 28 pass through an image/video processor 44 which encodes and decodes the various image frames. A separate audio processor 46 may also be present controlling signals to and from the speakers 34 and the microphone 24. The graphical display interface 20 is refreshed from a frame memory 48 as controlled by a user interface chip 50 which may process signals to and from the display interface 20 and/or additionally process user inputs from the keypad 22 and elsewhere.

Certain embodiments of the UE 10 may also include one or secondary radios such as a wireless local area network radio WLAN 37 and a Bluetooth® radio 39, which may incorporate an antenna on-chip or be coupled to an off-chip antenna. In an embodiment one or more of these secondary radios is disposed on the second PWB and folded over the top of the first PWB, with the operable antenna disposed on the flexible substrate that electrically connects the first and second PWBs to one another.

Throughout the apparatus are various memories such as random access memory RAM 43, read only memory ROM 45, and in some embodiments removable memory such as the illustrated memory card 47 on which the various programs 10C are stored. All of these components within the UE 10 are normally powered by a portable power supply such as a battery 49.

The aforesaid processors 38, 40, 42, 44, 46, 50, if embodied as separate entities in a UE 10, may operate in a slave relationship to the main processor 10A which may then be in a master relationship to them. These various processors may be disposed on one or the other of the first and second PWBs. Note that the various chips (e.g., 38, 40, 42, etc.) that were described above may be combined into a fewer number than described and, in a most compact case, may all be embodied physically within a single chip.

Various exemplary embodiments of the invention provide one or more of the following technical effects:

The integrated antenna with the described embedded flex portion enables better performance as compared to a conventionally integrated antenna on PWB, due to larger physical separation with air as an intermediate dielectric media.

The integrated antenna described by example herein enables a three dimensional mechanical placement of the antenna in a desired location such as the vicinity of covers, and sufficient distance from interfering electronics (engines/modules).

The integrated antenna described by example herein enables maximum ground and signal structure without metallic inner layers in the PWB structure.

The integrated antenna described by example herein enables assembly on the rigid portion of the second PWB simultaneously with another engine/module on the first PWB.

The embedded flexible portion (without a rigid end part of the second PWB) with the antenna circuitry disposed on a polyimide layer or equivalent material enables enhanced performance with low dielectric constant and low loss materials as the antenna circuit carrier material.

The flexible portion (without a rigid end part) with the partially embedded section enables testing of the flexible portion (for example, testing for impedance and return loss) before the antenna on the e-flex portion is applied in the rigid portion, and therefore increasing yield while reducing cost at the manufacturing level.

The PWB structure is changed from a 4 layer multi layer board MLB to an E-flex PWB comprising a 1+2 E-Flex+1 layer structure such as is described above for doubling the layers shown at FIG. 4 for the flexible portion 408, where '1' is a single layer of conventional PWB structure and "2" is a double layer of the e-flex portion. In this structure conventional PWB materials of resin coated copper foil or RCC and glass reinforced epoxy or FR4 may be used. While it may appear that there is a cost penalty with that new structure, in fact for the case of more complex structures this could prove to be the more cost effective implementation since it avoids the removable connectors and reduces separate processing blocks for mounting of certain modules and streamlines the assembly of the antenna. In an embodiment the dielectric constant in the 1 GHz and 2 GHz frequency range of RCC is approximately 3-3.6 and FR4 is 4.0-5.0 depending on the resin/glass cloth ratio and fillers used in the resin. The losses of RCC and FR4 in those embodiments are of a magnitude of 0.01-0.03. The polyimide dielectric constant in an equivalent range is approximately 2.5-3.5 for those exemplary embodiments, but the losses are lower than PWB materials.

Various modifications and adaptations to the foregoing exemplary embodiments of this invention may become apparent to those skilled in the relevant arts in view of the foregoing description, when read in conjunction with the accompanying drawings. However, any and all modifications will still fall within the scope of the non-limiting and exemplary embodiments of this invention.

It should be noted that the terms "connected," "coupled," or any variant thereof, mean any connection or coupling, either direct or indirect, between two or more elements, and may encompass the presence of one or more intermediate elements between two elements that are "connected" or "coupled" together. The coupling or connection between the elements can be physical, logical, or a combination thereof, except that the flexible substrate physically connects the first and second PWBs to one another. As employed herein an considering the exception noted immediately above, two elements may be considered to be "connected" or "coupled" together by the use of one or more wires, cables and/or printed electrical connections, as well as by the use of electromagnetic energy, such as electromagnetic energy having wavelengths in the radio frequency region, the microwave region and the optical (both visible and invisible) region, as several non-limiting and non-exhaustive examples.

Furthermore, some of the features of the various non-limiting and exemplary embodiments of this invention may be used to advantage without the corresponding use of other features. As such, the foregoing description should be considered as merely illustrative of the principles, teachings and exemplary embodiments of this invention, and not in limitation thereof.

I claim:

1. An apparatus comprising:

a first printed wiring board comprising a core having a power layer and a ground layer;

a second printed wiring board comprising a flexible portion that is partially embedded within an end section of the first printed wiring board and abutting the core, wherein the flexible portion comprises a first layer comprising an antenna feed coupled to the power layer of the core, and a second layer, wherein the second layer comprises a ground feed coupled to the ground layer of the core;

at least one antenna disposed within or on the second printed wiring board and coupled to the antenna feed, wherein the second printed wiring board comprises the flexible portion and no rigid portion;

a ground plane coupled to the ground feed and configured to resonate with the at least one antenna at a predetermined radio frequency band; and at least one radio disposed within or on the first printed wiring board and having circuitry configured to electrically match with the at least one antenna.

2. The apparatus according to claim 1, further comprising at least one antenna disposed within the second printed wiring board and coupled to the antenna feed;

in which the second printed wiring board comprises a rigid portion and the flexible portion, and the at least one antenna is disposed at least in part along the flexible portion.

3. The apparatus according to claim 1, further comprising at least one antenna disposed within the second printed wiring board and coupled to the antenna feed;

in which the second printed wiring board comprises a rigid portion and the flexible portion, and the at least one antenna is disposed at least in part along the rigid portion.

4. The apparatus according to claim 2, in which the said core of the first printed wiring board is a first core and the rigid portion of the second printed wiring board comprises a second core, and the flexible portion is partially embedded within an end section of the rigid portion of the second printed wiring board and abutting the second core.

5. The apparatus according to claim 2, in which the said core of the first printed wiring board is a first core and the rigid portion of the second printed wiring board comprises a second core, and the first layer and the second layer of the flexible portion extend through the entirety of the rigid portion and form layers of the second core.

6. The apparatus according to claim 1, in which the flexible portion comprises at least four distinct conductive layers.

7. The apparatus according to claim 1, further comprising a switch configured to actively switch the at least one antenna between an active antenna mode and a passive antenna mode.

8. The apparatus according to claim 1, in which the ground plane is disposed within one of the first printed wiring board or the rigid portion.

9. The apparatus according to claim 1, disposed within a portable electronic device with the flexible portion folded such that at least a portion of the second printed wiring board overlies a major surface of the first printed wiring board and is spaced therefrom by an air gap.

10. The apparatus according to claim 1, disposed within a portable electronic device such that the entire second printed wiring board lies adjacent to and coplanar with the first printed wiring board.

11. An apparatus comprising:

rigid first substrate means comprising a core having a power layer and a ground layer;

second substrate means comprising a flexible portion that is partially embedded within an end section of the first rigid substrate means and abutting the core, wherein the flexible portion comprises a first layer comprising antenna feeding means coupled to the power layer of the core, and a second layer, wherein the second layer comprises a ground feed coupled to the ground layer of the core;

antenna means disposed within or on the second substrate means and coupled to the antenna feeding means, wherein the second substrate means comprises the flexible portion and no rigid portion;

a ground plane coupled to the ground feeding means for resonating with the antenna means at a predetermined radio frequency band; and radio means disposed within or on the first substrate means and having circuitry electrically matching with the antenna means.

12. The apparatus according to claim 11, further comprising antenna means disposed within the second substrate means and coupled to the antenna feeding means;

in which the second substrate means comprises a rigid portion and the flexible portion, and the antenna means is disposed at least in part along the flexible portion.

13. The apparatus according to claim 11, further comprising antenna means disposed within the second substrate means and coupled to the antenna feeding means;

in which the second substrate means comprises a rigid portion and the flexible portion, and the antenna means is disposed at least in part along the rigid portion.

14. The apparatus according to claim 12, in which the said core of the rigid first substrate means is a first core and the rigid portion of the second substrate means comprises a second core, and the flexible portion is partially embedded within an end section of the rigid portion of the second substrate means and abutting the second core.

15. The apparatus according to claim 12, in which the said core of the first substrate means is a first core and the rigid portion of the second substrate means comprises a second core, and the first layer and the second layer of the flexible portion extend through the entirety of the rigid portion and form layers of the second core.

16. The apparatus according to claim 11, further comprising switching means for actively switching the antenna means between an active mode and a passive mode.

* * * * *